US009539157B2

(12) United States Patent
Liu

(10) Patent No.: US 9,539,157 B2
(45) Date of Patent: Jan. 10, 2017

(54) ROTATING BED FOR MEDICAL CARE

(71) Applicant: CAREMED SUPPLY INC., New Taipei (TW)

(72) Inventor: Tsung Hsuan Liu, Taipei (TW)

(73) Assignee: CAREMED SUPPLY INC., New Taipei (TW)

( * ) Notice: Subject to any disclaimer, the term of this patent is extended or adjusted under 35 U.S.C. 154(b) by 0 days.

(21) Appl. No.: 14/716,860

(22) Filed: May 19, 2015

(65) Prior Publication Data

US 2015/0335508 A1 Nov. 26, 2015

(30) Foreign Application Priority Data

May 22, 2014 (TW) ..... 103117976 A

(51) Int. Cl.
*A47C 21/02* (2006.01)
*A47C 19/00* (2006.01)
(Continued)

(52) U.S. Cl.
CPC ..... *A61G 7/10* (2013.01); *A61G 7/012* (2013.01); *A61G 7/015* (2013.01); *A61G 7/018* (2013.01); *A61G 7/16* (2013.01); *A61G 7/057* (2013.01)

(58) Field of Classification Search
CPC ..... A47C 21/02; A47C 21/028; A47C 19/00; A47C 19/02; A61G 7/012; B66C 23/84; B66C 23/86
(Continued)

(56) References Cited

U.S. PATENT DOCUMENTS 832,680 A * 10/1906 Lawrence ..... A61G 7/005 5/600
1,058,076 A * 4/1913 Loweree ..... A61G 7/012 5/611

(Continued)

*Primary Examiner* — Peter M Cuomo
*Assistant Examiner* — Ifeolu Adeboyejo
(74) *Attorney, Agent, or Firm* — Rabin & Berdo, P.C.

(57) ABSTRACT

The present invention provides a rotating bed for medical care, which includes: a bed frame structure, a bed body structure as well as a pivotal turning structure. The bed frame structure includes a fixed support. The bed body structure includes a connecting support, and the connecting support is located on top of the fixed support. The pivotal turning device includes a rotating axis that is fixed on the connecting support and a starting unit that is in connection with the bed frame structure. Moreover, the rotating axis includes a plurality of pivoted arms. The starting unit includes an extendable element that is able to drive the rotation of the plurality of pivoted arms, whereby when the length of the extendable element of the starting unit is extended or retracted, the plurality of pivoted arms rotate while encircling the core of the rotating axis as a result of the extendable element extending or retracting its length, and this has the effect of driving the rotation of the bed body structure at the same time, so as to enable the bed body structure located in between the deflected position that projects from a side of the bed frame structure and a placement position that does not project from a side of the bed frame structure to rotate back and forth. The present invention is able to assist the patients to get into and out of bed with convenience, by means of the bed body structure being rotated at the deflected position.

11 Claims, 14 Drawing Sheets

(51) Int. Cl.

| | |
|---|---|
| ***A47C 19/02*** | (2006.01) |
| ***A61G 7/10*** | (2006.01) |
| ***A61G 7/012*** | (2006.01) |
| ***A61G 7/015*** | (2006.01) |
| ***A61G 7/018*** | (2006.01) |
| ***A61G 7/16*** | (2006.01) |
| *A61G 7/057* | (2006.01) |

(58) Field of Classification Search
USPC ..... 5/610, 611, 612, 613, 81 RP; 212/245
See application file for complete search history.

(56) References Cited

U.S. PATENT DOCUMENTS 1,581,994 A * 4/1926 Duncan ..... A47C 17/163 5/617
4,457,656 A * 7/1984 Kosina ..... B65H 31/3081 104/37
4,862,529 A * 9/1989 Peck ..... A61G 7/16 5/611
6,957,461 B2 * 10/2005 Osborne ..... A61G 7/005 5/600
7,373,677 B2 * 5/2008 Barthelt ..... A61G 7/015 5/612
7,520,005 B2 * 4/2009 Barthelt ..... A61G 7/053 5/618
8,069,513 B2 * 12/2011 Turner ..... A61G 1/04 5/613
2002/0059679 A1 * 5/2002 Weismiller ..... A61G 7/002 5/610
2005/0172405 A1 * 8/2005 Menkedick ..... A61B 5/1115 5/618
2006/0236458 A1 * 10/2006 Barthelt ..... A61G 7/053 5/613
2009/0101234 A1 * 4/2009 Hart ..... A01G 23/067 144/24.12

* cited by examiner

ROTATING BED FOR MEDICAL CARE

FIELD OF THE INVENTION

The present invention relates generally to a medical bed, and more particularly, the present invention relates to an improved structure of a rotating bed that is able to assist patients to get into and out of bed, and the improved structure of a rotating bed may be selectively rotated at the side of the bed frame structure, by means of the bed body structure.

BACKGROUND OF THE INVENTION

Patients who are in a vegetative state and patients who have experienced paralysis, stroke or spinal cord injury are not able to move on their own. These patients often need to rest in bed for a long period of time, and this is due to the restriction on their mobility and activities. During the period that these patients are lying in bed, the health care professionals need to occasionally flip over the body of these patients, so as to change the centre of mass of the body part of the patient that is in direct contact with the bed, and as such also avoiding the formation of bedsores as a result of the deposition of bloodstream of some body parts of the patient.

In addition, the number of the patients with reduced mobility and the number of patients who are bedridden gradually increase every year, however, the number of health care professionals cannot be increased accordingly. In the past, when the health care professionals help patients to get out of bed, the range of movement and the width of movement required by the patient are large during the process when the patient moves on the bed until the patient stands up on the ground. Also, when the patient is getting out of bed, the width as well as the distance that the patient needs to cross from the bed body is relatively large, and this can bring quite a large physical burden to the patient.

In view of the above, there are still inadequacies associated with the use of the conventional medical bed, and there is still a need for the manufacture of a bed structure that is able to assist the patients to get into and out of bed.

SUMMARY OF THE INVENTION

The main objective of the present invention is to assist patients to get into and out of a rotating bed with convenience, without increasing the burden to the patients while they are getting into and out of the rotating bed.

The other objective of the present invention is that the relative height between a rotating bed and the floor and the swinging angle of the bed body structure relative to the bed frame structure can be adjusted, so as to bring convenience to the patients while the patients are using the improved structure of a rotating bed. As such, the above-mentioned adjustments can be done in accordance with the height of the patients and needs of the patients.

Yet another objective of the present invention is to effectively withstand the burden to the rotating bed caused by the patient when the patient is using the rotating bed, so as to enable the patients to convalesce well while they are lying on the rotating bed.

In order to achieve the above-mentioned objectives of the present invention, the present invention is related to a rotating bed for medical care, which includes the following components: a bed frame structure that includes a fixed support and a frame body, whereby a lifting and lowering device is assembled between the fixed support and frame body, and the lifting and lowering device is used for changing a spacing distance in between the fixed support and the frame body; a bed body structure that is located on top of the fixed support, while the bed body structure may include a connecting support as well as a bed plate, and the connecting support may include a base, the two ends of the base respectively extend upwards so as to form a support member that is installed on the bed plate, the support member may include a sliding track; a pivotal turning device that is located in between the bed frame structure and the bed body structure, may include a rotating axle and a starting unit, whereby the rotating axle may be fixed on the connecting support, and may include a plurality of pivoted arms, and the starting unit is in connection with the bed frame structure, and may include an extendable element that is pivoted with the plurality of pivoted arms; a bearing that is located in between the fixed support of the bed frame structure and the connecting support of the bed body structure. In addition, the surfaces of the bearing are respectively in direct contact with the fixed support and the connecting support, and the bearing may enable the rotating axle to pass through.

Moreover, when the length of the extendable element of the starting unit is extended or retracted, the plurality of pivoted arms may rotate while encircling a core of the rotating axle, and may drive the rotation of the bed body structure, so as to enable the bed body structure to be located in between the deflected position that projects from a side of the bed frame structure and a placement position that does not project from a side of the bed frame structure to rotate back and forth. As such, at the same time, the starting unit may provide a swinging back and forth action as a result of the plurality of pivoted arms rotating while encircling the core of the rotating axle.

In accordance with a preferred exemplary embodiment of the present invention, the pivotal turning device may further include an auxiliary extendable member, whereby the auxiliary extendable member may include a supporting end and an extendable end that are in connection with the bed frame structure. The extendable end may be installed on another pivoted arm, and the auxiliary extendable member may provide a back and forth swinging action at the same time as a result of the plurality of pivoted arms rotating while encircling a core of the rotating axle.

Preferably, the lifting and lowering device may include two swing frames that are pivoted with the two ends of the fixed plate, a plurality of guided tracks that may be installed on the frame body as well as two first driving sources. In addition, a connecting rod may be located on one side of the swing frame, and two sliding blocks that slide in the guided tracks may be installed on the relative side of the connecting rod that is in connection with the swing frame, and the first driving source may be in connection with the bed frame structure, and may include a first extendable rod that is installed on the connecting rod.

In addition to the above, the bed plate may include a fixed plate that is fixed at the top ends of the two support members, and may include a first flipped plate that is located on a side of the fixed plate. A first flipped device may be assembled between the first flipped plate and the base, the first flipped device may enable the first flipped plate to carry out the flipping while the first flipped plate is faced towards the upper surface of the fixed plate.

Preferably, the first flipped device may include the following components: a second driving source that is located in between the two support members may be installed on the base, and may include a second extendable rod; a movable member that is installed on the second extendable rod, and the movable member moves in a linear manner while facing the direction of the two ends of the support member, as a result of the changes in length of the second extendable rod. In addition, the movable member may also include a movable block that is installed on a sliding track; at least a prop member, whereby one end of the at least a prop member turns pivotally to the movable member, and another end of the at least a prop member may be fixed on the first flipped plate; and at least a limiting member, whereby one end of the at least a limiting member may be pivoted on the support member, and another end of the at least a limiting member may be pivoted with the at least a prop member, when the second extendable rod extends or retracts its length, so as to enable the movable member to move in a linear manner towards one end of the support member, this may drive the flipping of the prop member and the limiting member, and the flipping of the at least a prop member and the at least a limiting member may become a folded state, so as to enable the first flipped plate to flip while facing the upper surface or lower surface of the fixed plate.

In addition, the bed plate may further include a second flipped plate, whereby the second flipped plate may be installed on a relative end of the fixed plate that is relative to the first flipped plate; the second flipped device may be assembled between the second flipped plate and the base; and the second flipped device may enable the second flipped plate to carry out flipping while the second flipped plate is faced towards the lower surface of the fixed plate.

Preferably, the second flipped device may include the following components: a third driving source that is installed on the base, wherein the third driving source may be located in between the two support members, and may include a third extendable rod; a positioning support that may include two fixed members that are fixed on the bed body structure, whereby a rotating rod that rotates while in connection with the fixed member may be assembled between the two fixed members; the rotating rod may include a pivoted section that is pivoted to the third extendable rod, and may include a contact section that is installed on the second flipped plate; wherein when the length of the third extendable rod is retracted or extended, the rotating rod carries out the rotation by means of the pivoted section, so as to enable the contact section of the rotating rod to drive the flipping of the second flipped plate towards the lower surface or upper surface of the fixed plate.

Lastly, the third flipped plate may be assembled between the fixed plate and the second flipped plate, and the two ends of the third flipped plate may be respectively pivoted with the fixed plate and the second flipped plate, wherein the upper surface of the second flipped plate and the upper surface of the fixed plate are presented horizontally. When the length of the third extendable rod is extended continuously, the third flipped plate may be flipped so as to form an inclined position, such that the second flipped plate and the third flipped plate are enabled to be located in different planes.

The distinguishing technical feature of the present invention lies in the fact that when the length of the extendable element of the driving unit is extended or retracted, the plurality of pivoted arms may rotate while encircling the core of the rotating axle, and this enables the rotation of the bed body structure to be driven, in order to enable the bed body structure that is located in between a deflected position that projects from a side of the bed frame structure and a placement position that does not project from a side of the bed frame structure to rotate back and forth. This has the effect of helping the patient to get into and out of bed with convenience, without increasing the physical burden of the patient.

In addition, the other distinguishing technical features of the present invention include the following: the lifting and lowering device that is located in between the fixed support as well as the frame body of the bed frame structure is used for the adjustment of the spacing height that exists in between the fixed support and the frame body. Furthermore, when the lengths of the second extendable rod and the third extendable rod are extended and retracted by the second driving source and the third driving source, this has the effect of adjusting the tilting angle of the first flipped plate and the second flipped plate, so as to enable the rotating bed to represent different usage forms, such that the rotating bed can be used in accordance with the needs of the patient.

In addition, an additional distinguishing technical feature of the present invention lies in the fact that the bearing is installed in between the fixed support of the bed frame structure as well as the connecting support of the bed body structure. Furthermore, the upper end and lower end of the bearing may be in direct contact with the fixed support and the connecting support respectively. As such, the bed frame structure is able to withstand the burden of the weight of the patient and the weight of the bed body structure, by means of the bearing, and as such, the safety of the rotating bed can be increased. Also, the bed body structure may be able to carry out rotation that is faced towards the side of the bed frame structure, by means of a smaller rotational torque offered by the bearing. As such, the purpose of ease of use can be achieved.

BRIEF DESCRIPTION OF THE DRAWINGS

The present invention can be understood in more detail by reading the subsequent detailed description in conjunction with the examples and preferred exemplary embodiments made to the accompanying drawings, wherein.

DETAILED DESCRIPTION OF THE PREFERRED EMBODIMENT

The accompanying drawings are included to provide a further understanding of the invention, and are incorporated in and constitute a part of this specification. The drawings illustrate the preferred exemplary embodiments of the invention and, together with the description, serve to explain the principles of the invention.

Figure 1:
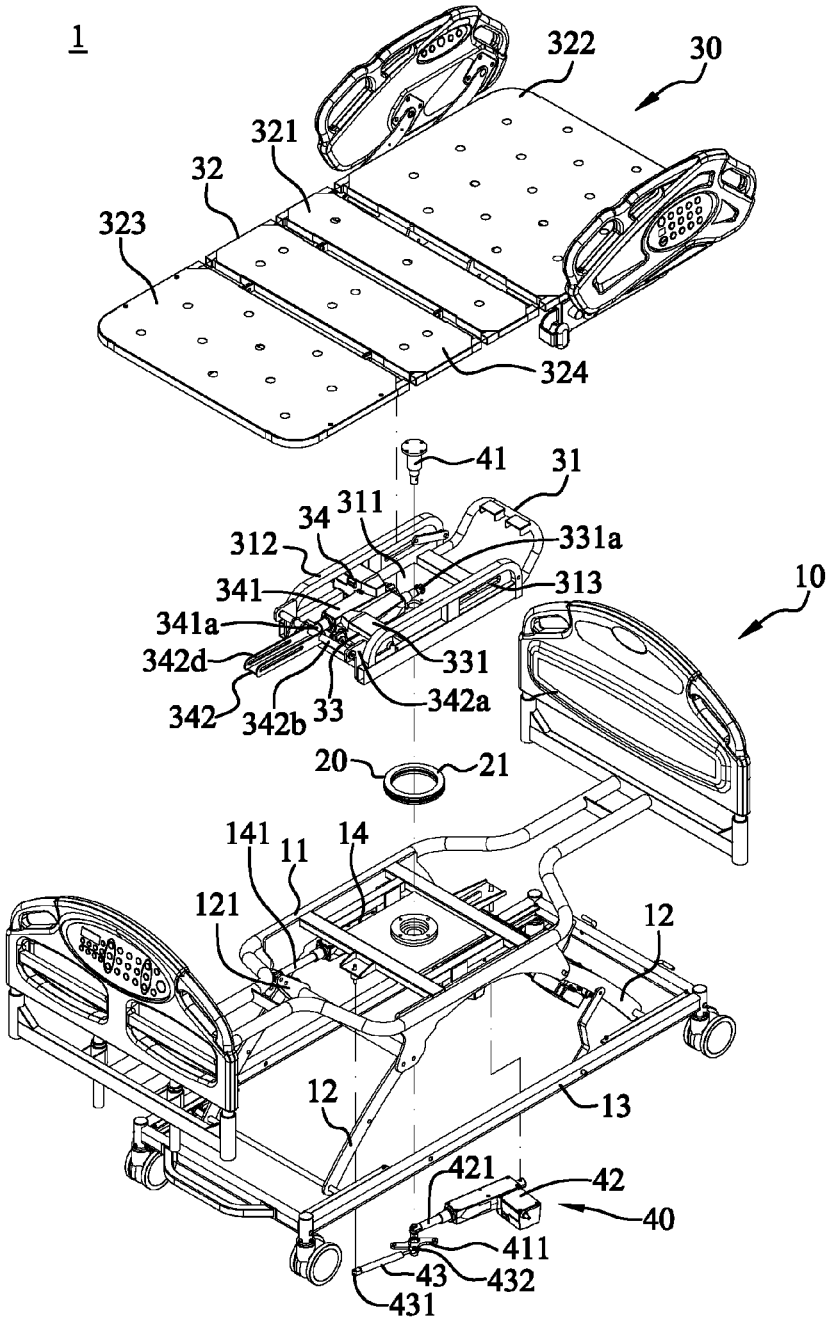
FIG. 1 is an exploded diagram showing the rotating bed in accordance with the preferred exemplary embodiment of the present invention.
Figure 2:
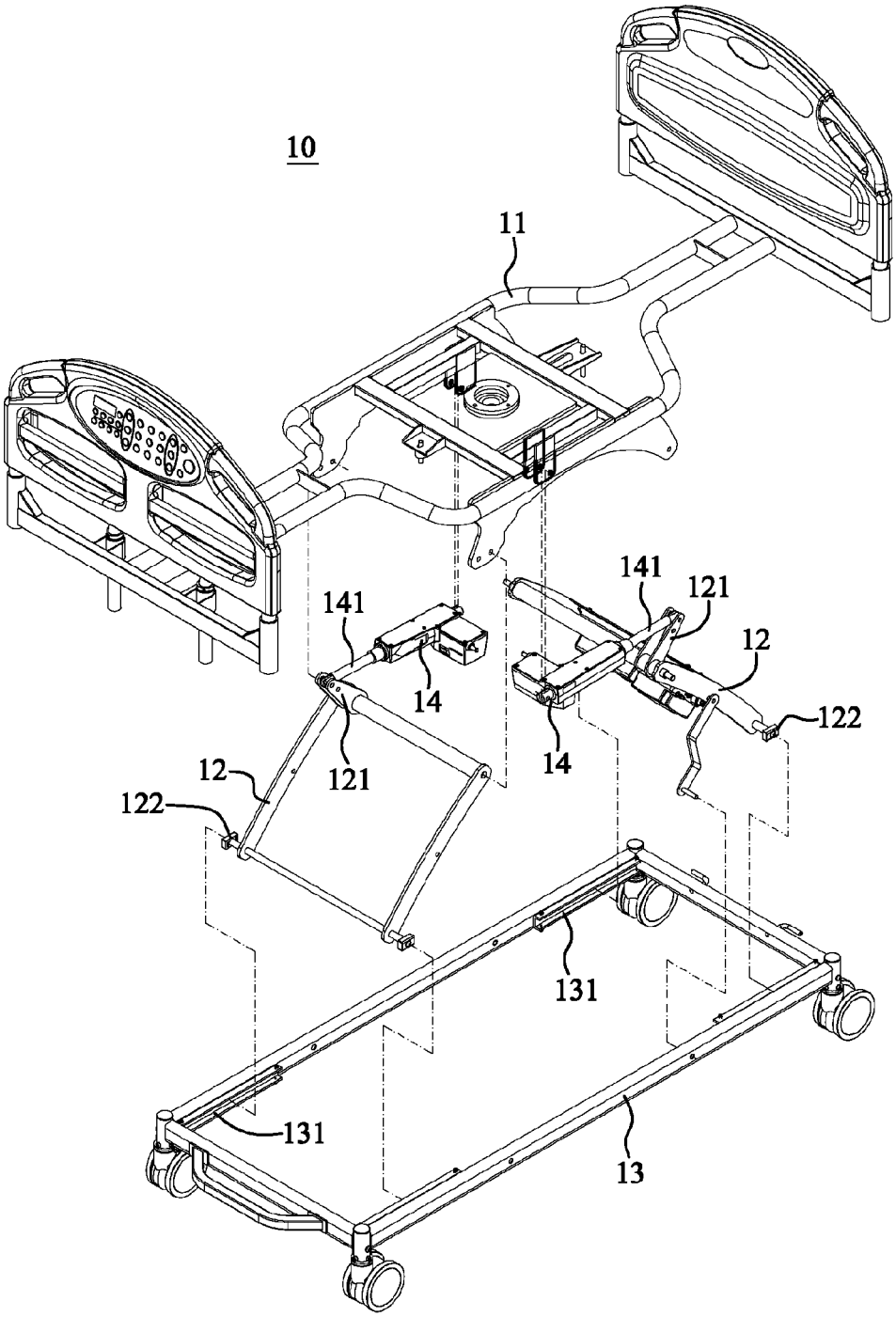
FIG. 2 is an exploded diagram showing the bed frame structure in accordance with the preferred exemplary embodiment of the present invention.

As shown in FIG. 1, the present invention is related to a rotating bed 1 for medical care. In accordance with a preferred exemplary embodiment of the present invention, the rotating bed 1 may be mainly made up of a bed frame structure 10, a bearing 20, a bed body structure 30 as well as a pivotal turning device 40. As shown in FIG. 2, the bed frame structure 10 may be mainly made up of a fixed support 11, two swing frames 12, a frame body 13 and two first driving sources 14. The left and right ends of the fixed support 11 may be pivoted with the swing frame 12. A connecting rod 121 may be installed on one side of the swing frame 12, and the relative side of the swing frame 12 may be installed with two sliding blocks 122. In addition, the frame body 13 may be located at the bottom of the fixed support 11, and may include four guided tracks 131 that may enable the sliding and connection of the sliding blocks 122. In addition, the first driving source 14 may be located in between the fixed support 11 and the frame body 13, and may be installed on the fixed support 11. In addition, the first driving source 14 may include a first extendable rod 141 that is installed on the connecting rod 121.

The bearing 20 may be located on top of the fixed support 11 of the bed frame structure 10, and the surface of the bearing 20 may be in direct contact with the fixed support 11. In accordance with a preferred exemplary embodiment of the present invention, the bearing 20 may be configured as a thrust roller needle bearing 21 that may be able to withstand and carry the load.

Figure 3:
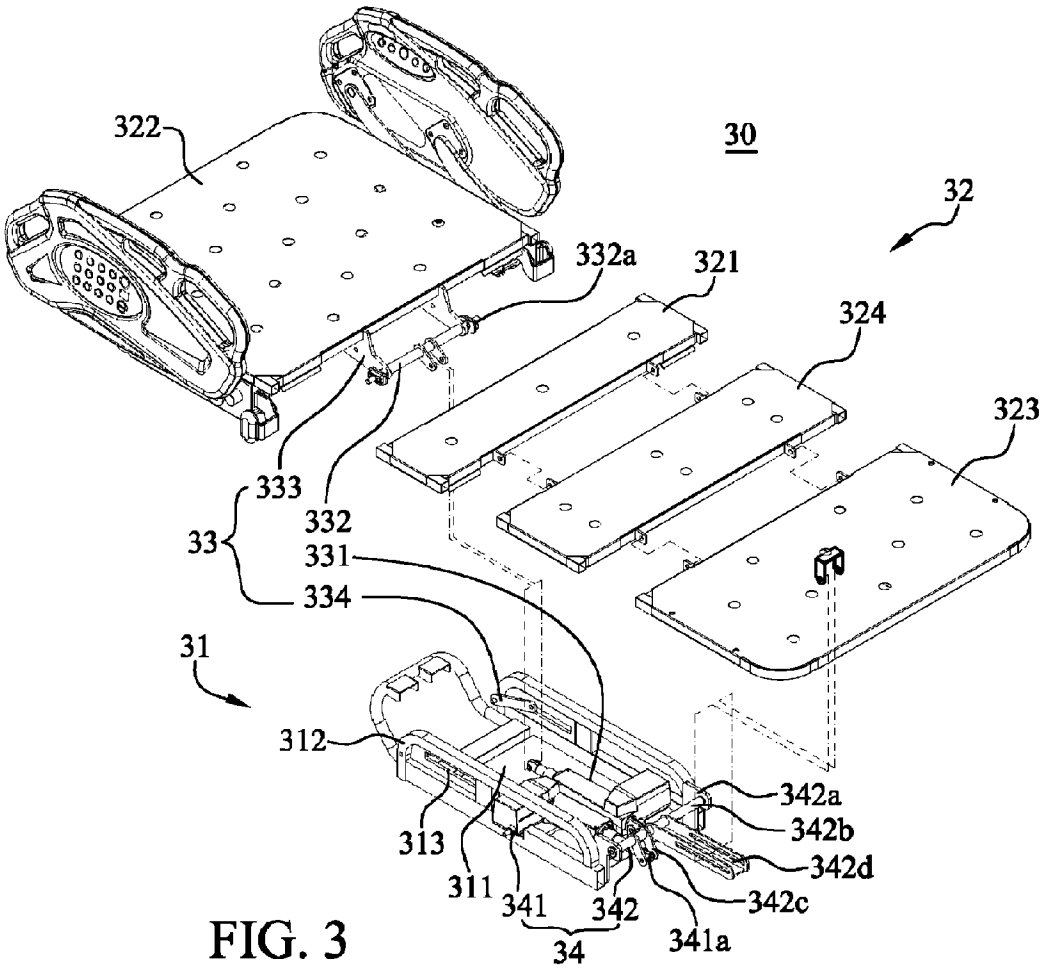
FIG. 3 is an exploded diagram showing the bed body structure in accordance with the preferred exemplary embodiment of the present invention.

As shown in FIG. 1 and FIG. 3, the bed body structure 30 may be located on top of the bed frame structure 10, so as to enable the bearing 20 to be located in between the bed frame structure 10 and bed body structure 30, and as such also enabling the bearing 20 to be used for carrying the weight of the bed body structure 30. In addition, the bed body structure 30 is mainly made up of a connecting support 31, a bed plate 32, a first flipped device 33 as well as a second flipped device 34. The connecting support 31 may include a base 311 that has surface contact with the bearing 20. The two ends of the base 311 may extend upwards and forming a support member 312; the support member 312 may have an orbital path 313.

In accordance with the preferred exemplary embodiment of the present invention, the bed plate 32 may include the following components: a fixed plate 321 that may be fixed at the top ends of the two support members 312; a first flipped plate 322 that may be located on one side of the fixed plate 321; a second flipped plate 323 that is located on the fixed plate 321, wherein the second flipped plate 323 is relative to the relative side of the first flipped plate 322; and a third flipped plate 324 that is located in between the fixed plate 321 and the second flipped plate 323. The two ends of the third flipped plate 324 may be pivoted with the fixed plate 321 and the second flipped plate 323, respectively.

Moreover, the first flipped device 33 may be mainly made up of a second driving device 331, a movable member 332, two prop members 333 as well as two limiting members 334. The second driving source 331 may be located and installed on the base 311, and may also be located in between the two support members 312. In addition, the second driving device 331 may also include a second extendable rod 331*a* that may be installed on the movable member 332. Furthermore, the movable member 332 may have two movable blocks 332*a* that are installed on the orbital path 313. One end of the two prop members 333 may be installed on the first flipped plate 322. The other end of the two prop members 333 may be pivoted with the movable member 332. The two ends of the two limiting members 334 may be pivoted with the support member 312 and the prop member 333, respectively.

In addition, the second flipped device 34 may be made up of a third driving source 341 as well as a positioning support 342. The third driving source 341 may be installed on the base 311, and the third driving source 341 may also be located in between the two support members 312. Also, the third driving device 341 may have a third extendable rod 341*a*. The positioning support 342 may have two fixed members 342*a* that are fixed at the connecting support 31 of the bed body structure 30. A rotating rod 342*b* that rotates and is in connection with the two fixed members 342*a* may be installed in between the two fixed members 342*a*. In addition, the rotating rod 342*b* may include a pivoted section 342*c* that is in connection with the third extendable rod 341*a*, and a contact section 342*d* that is installed on the bottom surface of the second flipped plate 323.

Figure 4:
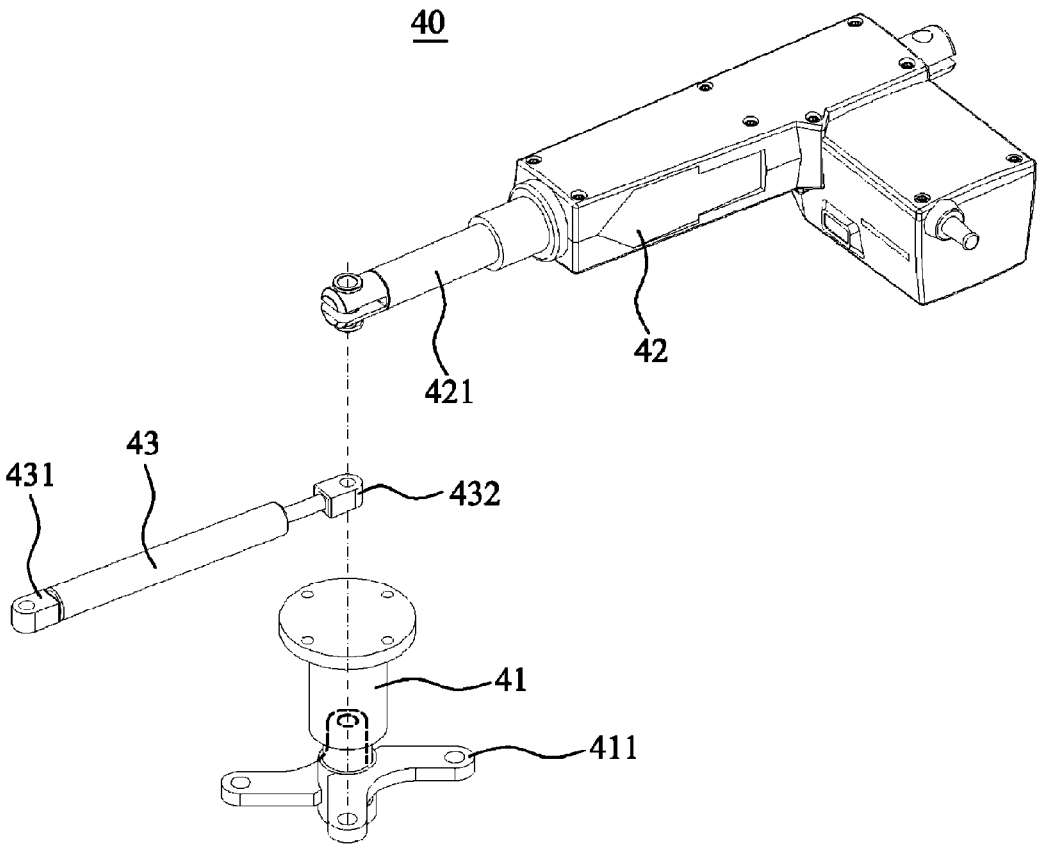
FIG. 4 is an exploded diagram showing the pivotal turning device in accordance with the preferred exemplary embodiment of the present invention.
Figure 5:
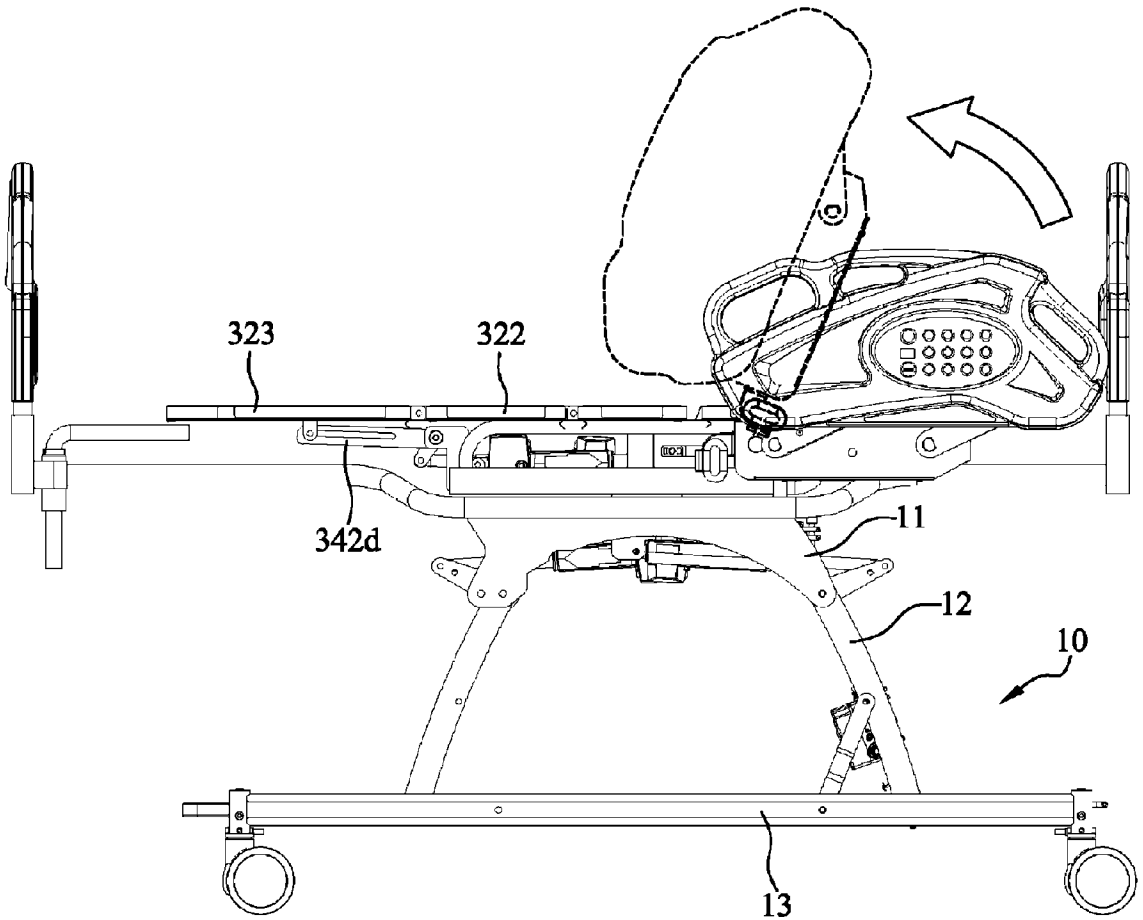
FIG. 5 is a schematic diagram showing the first flipped plate that is flipped by the first flipped device in accordance with the preferred exemplary embodiment of the present invention.
Figure 6:
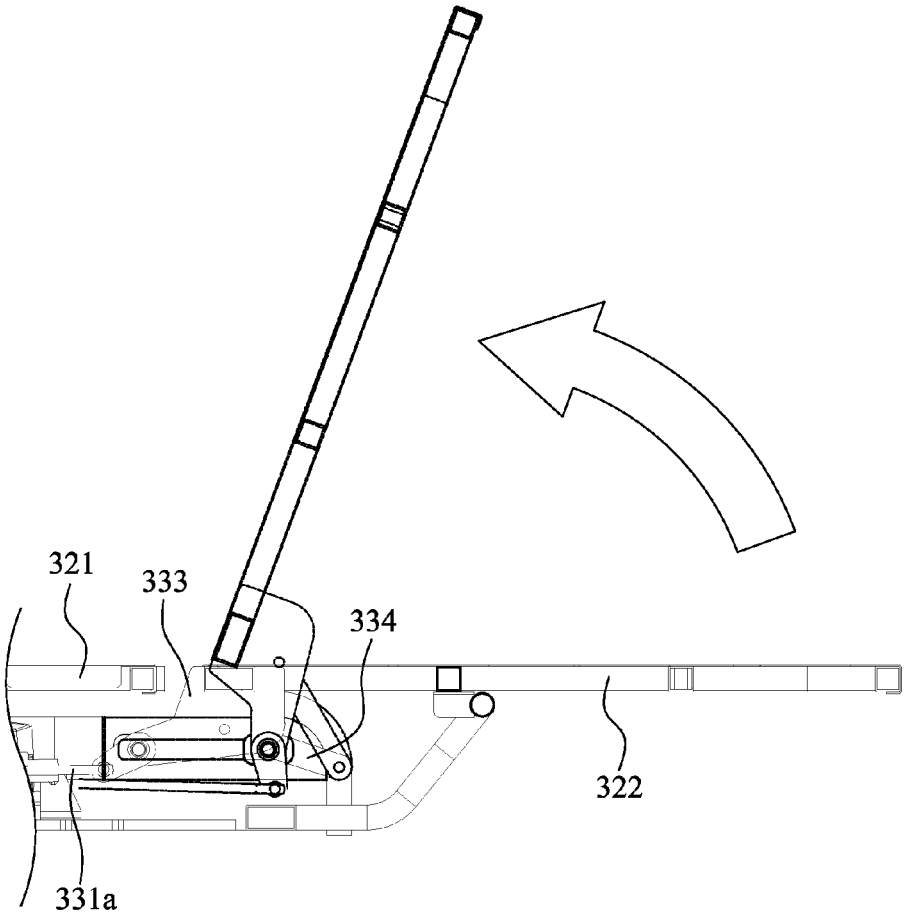
FIG. 6 is a schematic diagram showing the changes in assembly connection position between the prop member and the limiting member in accordance with the preferred exemplary embodiment of the present invention.

As shown in FIG. 4, the pivotal turning device 40 may be located in between the fixed support 11 of the bed frame structure 10 and the connecting support 31 of the bed body structure 30. In addition, the pivotal turning device 40 may be mainly made up of a rotating axle 41, a starting unit 42 as well as an auxiliary extendable member 43. The rotating axle 41 may be fixed at the connecting support 31 of the bed body structure 30, and may pass through the bearing 20 and the fixed support 11 of the bed frame structure 10. In addition, a rotating axle 41 may project outwards at the fixed support 11. Also, the rotating axle 41 that may be located at the bottom of the fixed support 11 of the bed frame structure 10 may have a plurality of pivoted arms 411 that have an equidistant arrangement.

Further, the starting unit 42 may be in connection with the fixed support 11 of the bed frame structure 10, and may include an extendable element 421 that rotates pivotally on top of the plurality of pivoted arms 411. Moreover, the auxiliary extendable member 43 may include a supporting end 431 that is in connection with the fixed support 11, and may also include an extendable end 432 that is installed on another pivoted arm 411, whereby the starting unit 42 that is installed at the assembly connecting position of the fixed support 11 and the auxiliary extendable element 421 that is installed at the assembly connecting position of the fixed support 11 may be located on the same straight line.

As shown in FIG. 5 to FIG. 10, the present invention provides a specific application that assist a patient to get into and out of bed. Please refer also to FIG. 1, FIG. 3, FIG. 5 and FIG. 6, the patient may lie down on the bed plate 32, and the length of the second extendable rod 331*a* of the second driving source 331 may be extended so as to drive the movable member 332 to move in a linear manner towards one end of the support member 312. At the same time, the movable block 332*a* may move along the orbital path 313, and the assembly connecting position between the prop member 333 and the limiting member 334 may be driven to form an upper displacement, such that the prop member 333 and the limiting member 334 may be flipped to form a folded state. As such, the first flipped plate 322 may gradually flip towards the upper surface of the fixed plate 321. When the movable block 332*a* moves along the orbital path 313 and hits one end of the orbital path 313, the first flipped plate 322 will immediately stop flipping, so as to enable the first flipped plate 322 relative to the fixed plate 321 to form a tilt-like state.

Figure 7:
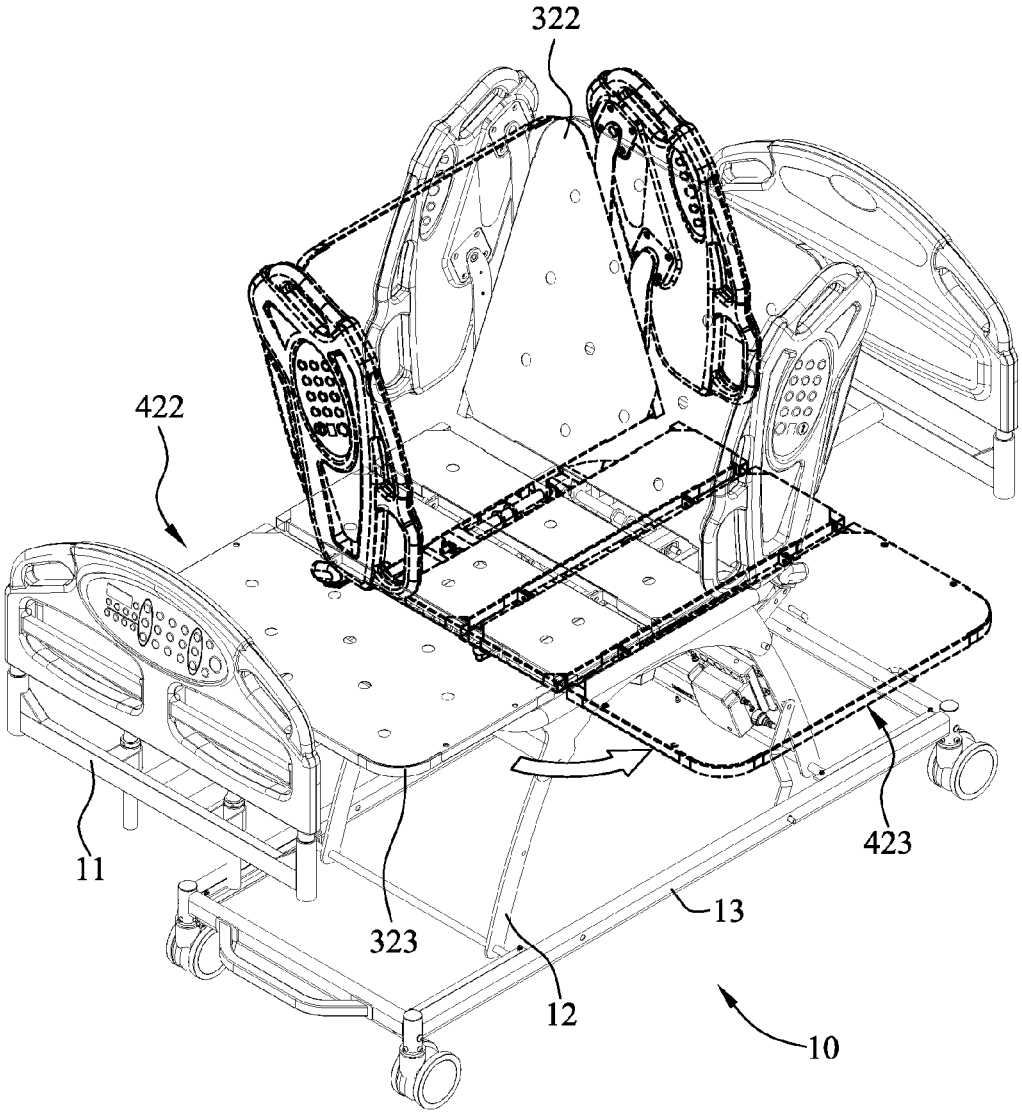
FIG. 7 is a schematic diagram showing the bed body structure that is being rotated by the pivotal turning device in accordance with the preferred exemplary embodiment of the present invention.
Figure 8:
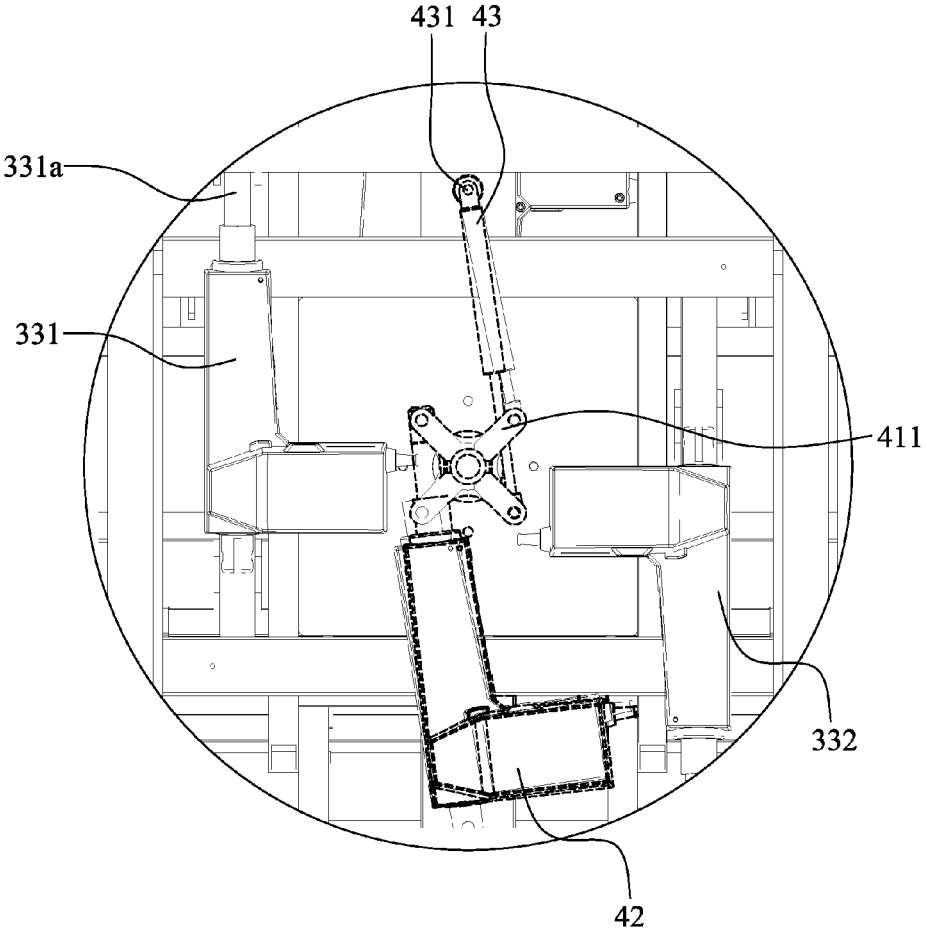
FIG. 8 is a schematic diagram showing the swinging back and forth action of the starting unit and the auxiliary extendable member in accordance with the preferred exemplary embodiment of the present invention.

As shown in FIG. 4, FIG. 7 and FIG. 8, when the length of the extendable element 421 of the starting unit 42 is not extended, the bed body structure 30 may be located in the placement position 422 that does not project from the bed frame structure 10. When the length of the extendable element 421 of the starting unit 42 is extended, the length of the extendable end 432 of the auxiliary extendable member 43 may be extended at the same time. In addition, the pivoted arm 411 of the rotating axle 41 may be driven so as to enable the pivoted arm 411 to rotate about the rotating axle 41 in a counterclockwise direction. As such, the bed body structure 30 may be driven to perform the rotation in a counterclockwise direction, such that the bed body structure 30 may be located in the deflected position 423 that projects from a side of the bed frame structure 10. At the same time, the starting unit 42 and the auxiliary extendable member 43 may provide a back and forth swinging action by means of the plurality of pivoted arms 411 rotating while encircling the core of the rotating axle 41.

Figure 9:
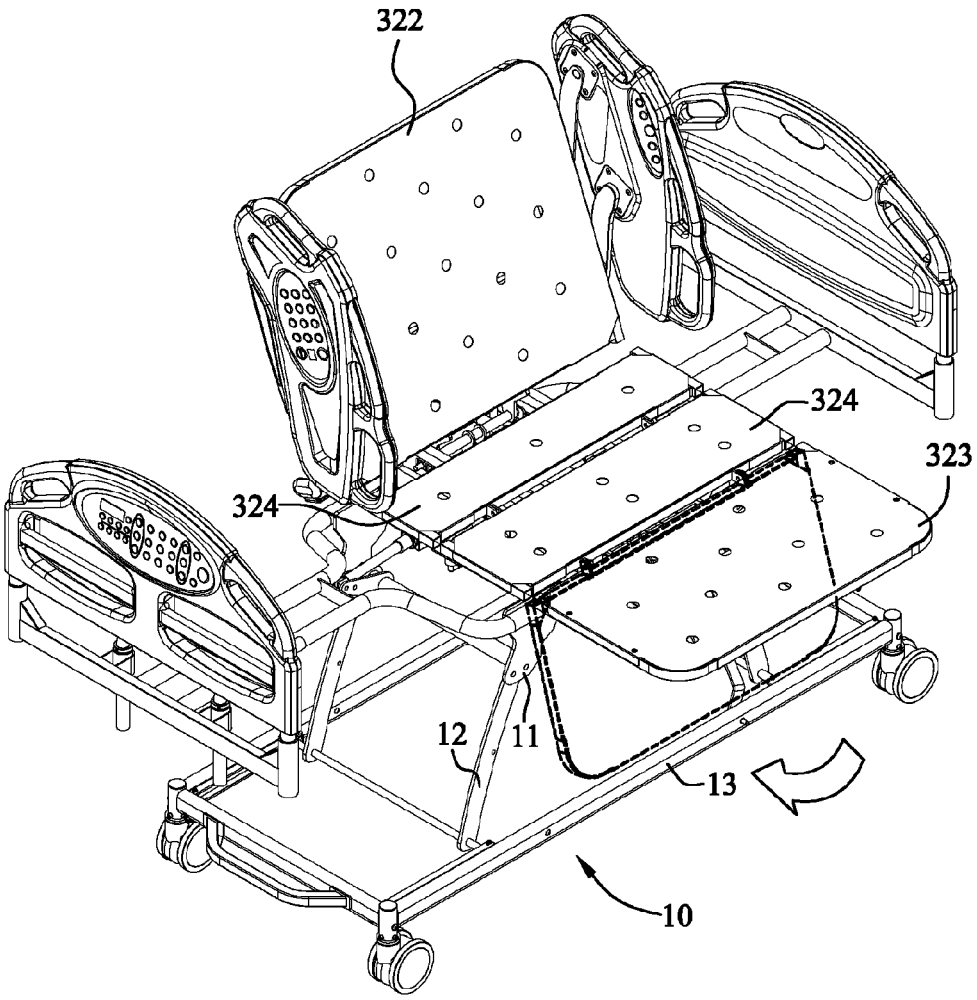
FIG. 9 is a schematic diagram showing the second flipped plate is being flipped by the second flipping device in accordance with the preferred exemplary embodiment of the present invention.

As shown in FIG. 3 and FIG. 9, the length of the third extendable rod 341*a* of the third driving source 341 is retracted, such that the pivoted section 342*c* may rotate about the core of the rotating road 342*b*. As such, the contact section 342*d* of the rotating road 342*b* may drive the second flipped plate 323, and may enable the second flipped plate 323 to flip towards the lower surface of the fixed plate 321.

Figure 10:
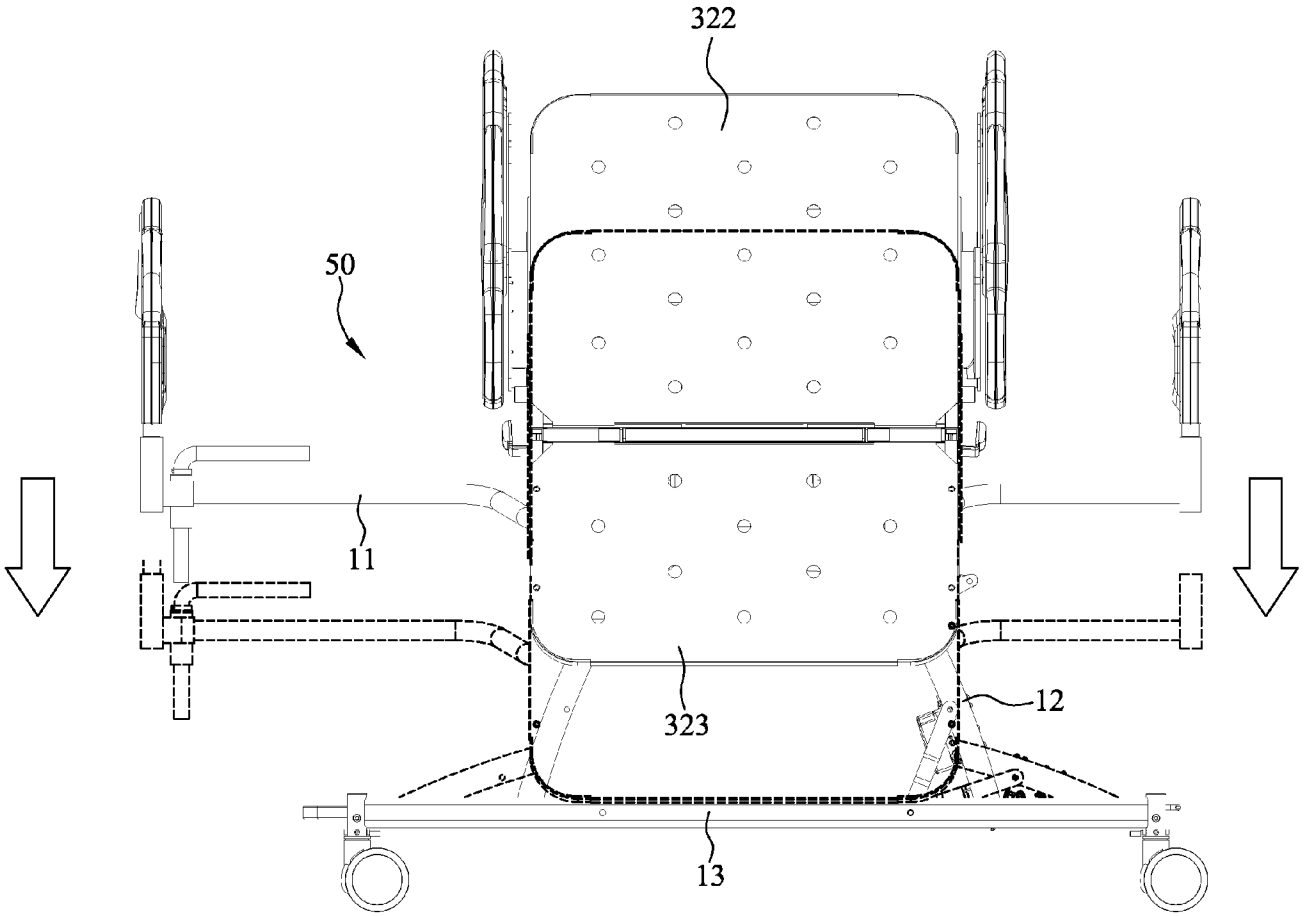
FIG. 10 is a schematic diagram showing the spacing distance in between the fixed support and the frame body is being changed by the lifting and lowering device in accordance with the preferred exemplary embodiment of the present invention.

As shown in FIG. 2 and FIG. 10, the length of the first extendable road 141 is retracted such that the swing frame 12 may be driven to flip outwards by means of the connecting road 121. At the same time, the sliding block 122 of the swing frame 12 may move along the guided track 131 towards two ends of the frame body 13. As such, the spacing distance that is in between the fixing support 11 and the frame body 13 may be retracted, so as to form a lifting and lowering device 50 by means of selectively changing the spacing distance in between the fixed support 11 and the frame body 13. In addition, when the feet of the patient touch the ground, the patient may carry out the action of getting out of the bed without any increase in the burden of the body.

Figure 11:
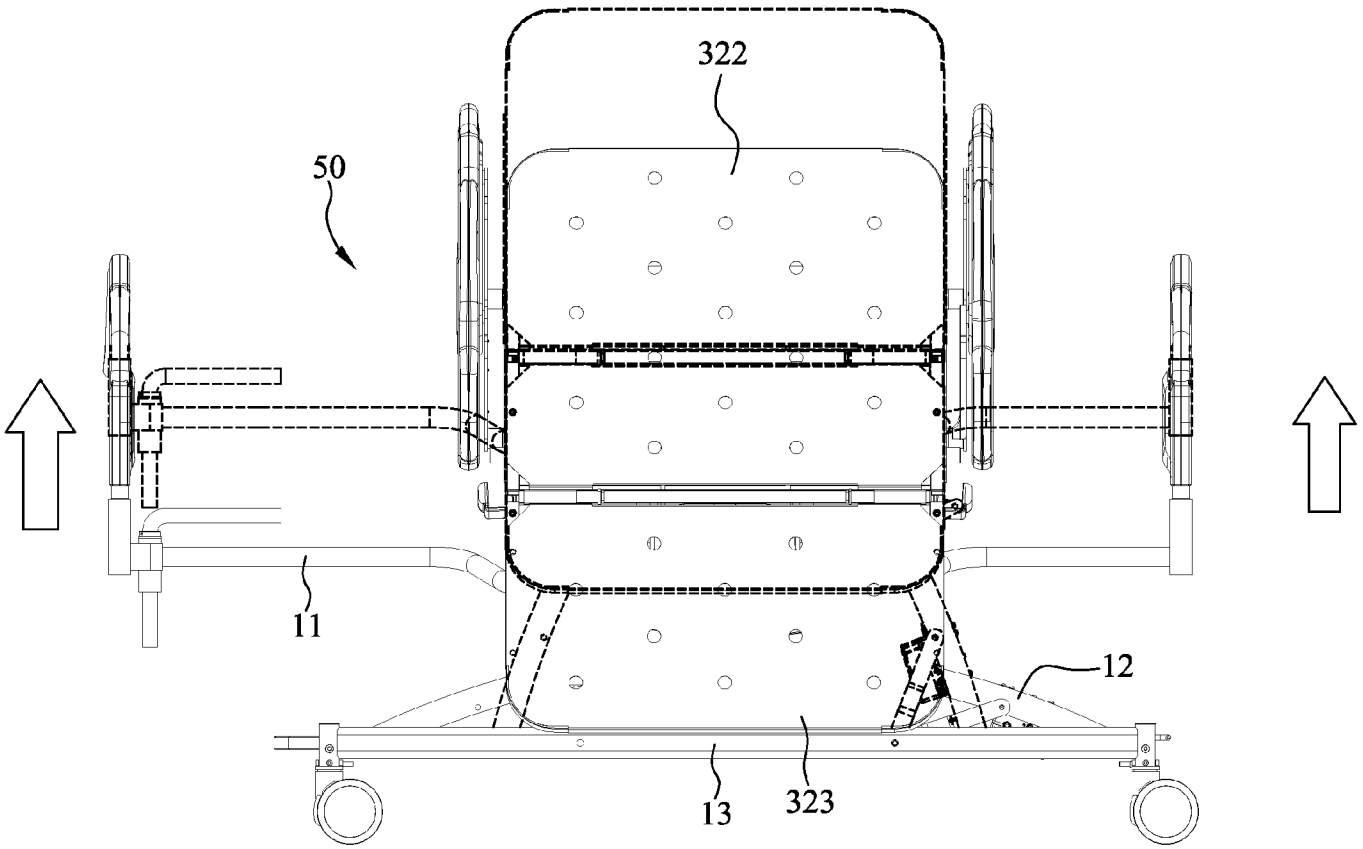
FIG. 11 to FIG. 14 are schematic diagrams showing the rotating bed assisting a patient get into bed in accordance with the preferred exemplary embodiment of the present invention.
Figure 14:
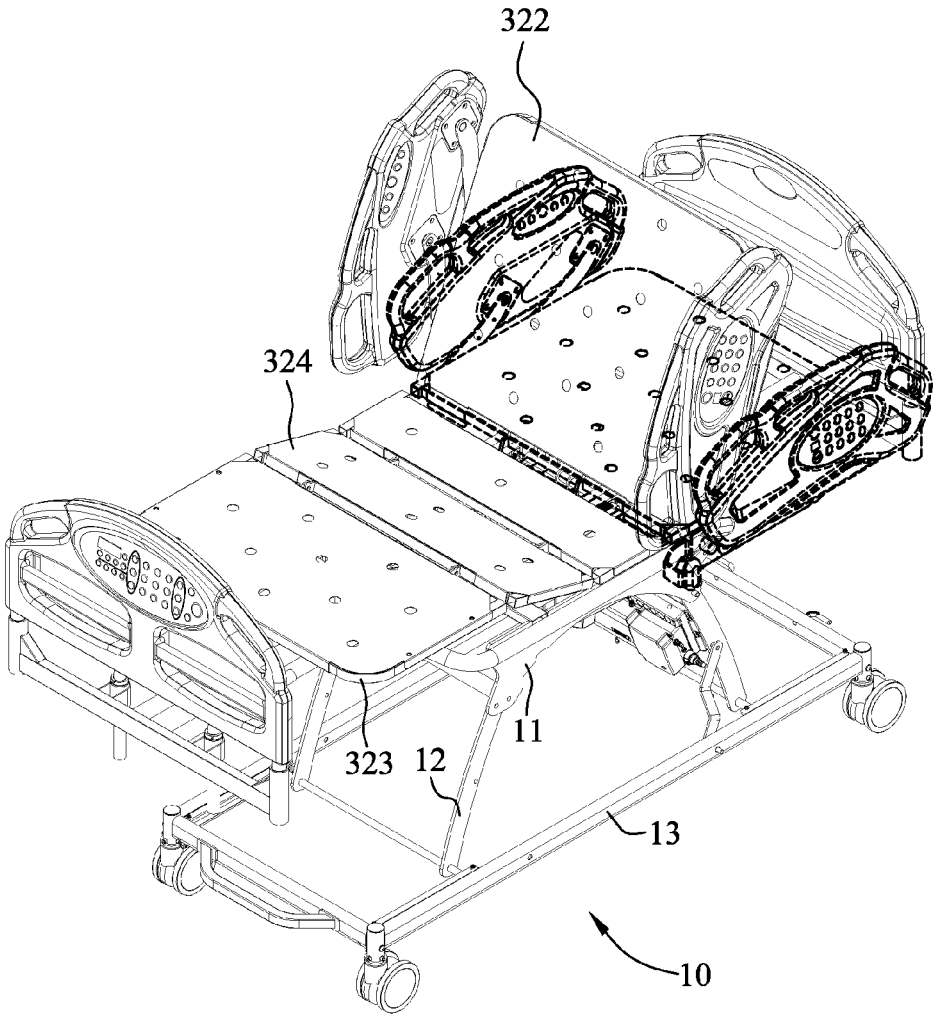

As shown in FIG. 11 and FIG. 14, the present invention provides a specific application that may assist a patient to get into and out of bed. Please refer to FIG. 1 and FIG. 11, when the length of the first extendable rod 141 of the first driving source 14 is extended, the connecting road 121 may drive the swing frame 12 towards the bottom end of the fixed support 11 to carry out a swinging action. At the same time, the sliding block 122 of the swing frame 12 may move along the guided track 131, such that the fixed support 11 may swing by means of the swing frame 12, and the sliding block 122 may slide along the guided track 131 in order to gradually move away from the frame body 13. As such, a spacing distance that is in between the fixed support 11 and the frame body 13 may be increased.

Figure 12:
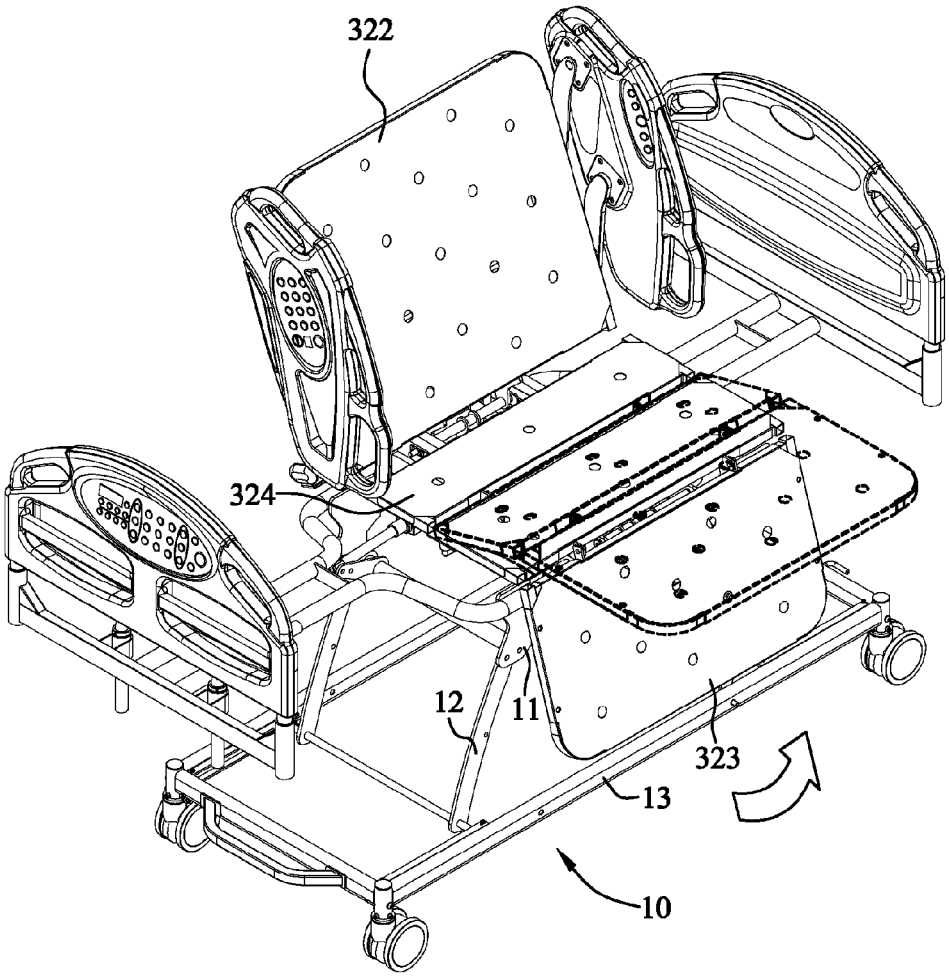

Please refer to FIG. 3 and FIG. 12, when the length of the third extendable rod 341*a* is extended, the third flipped plate 324 may be driven by the contact section 342*d*, and may be flipped towards the upper surface of the fixed plate 321. When the upper surface of the second flipped plate 323 and the upper surface of the fixed plate 321 are presented horizontally, and when the length of the third extendable rod 341*a* is extended continuously, the third flipped plate 324 may be flipped so as to form an inclined position, such that the second flipped plate 323 and the third flipped plated 324 may be located in different horizontal positions.

Figure 13:
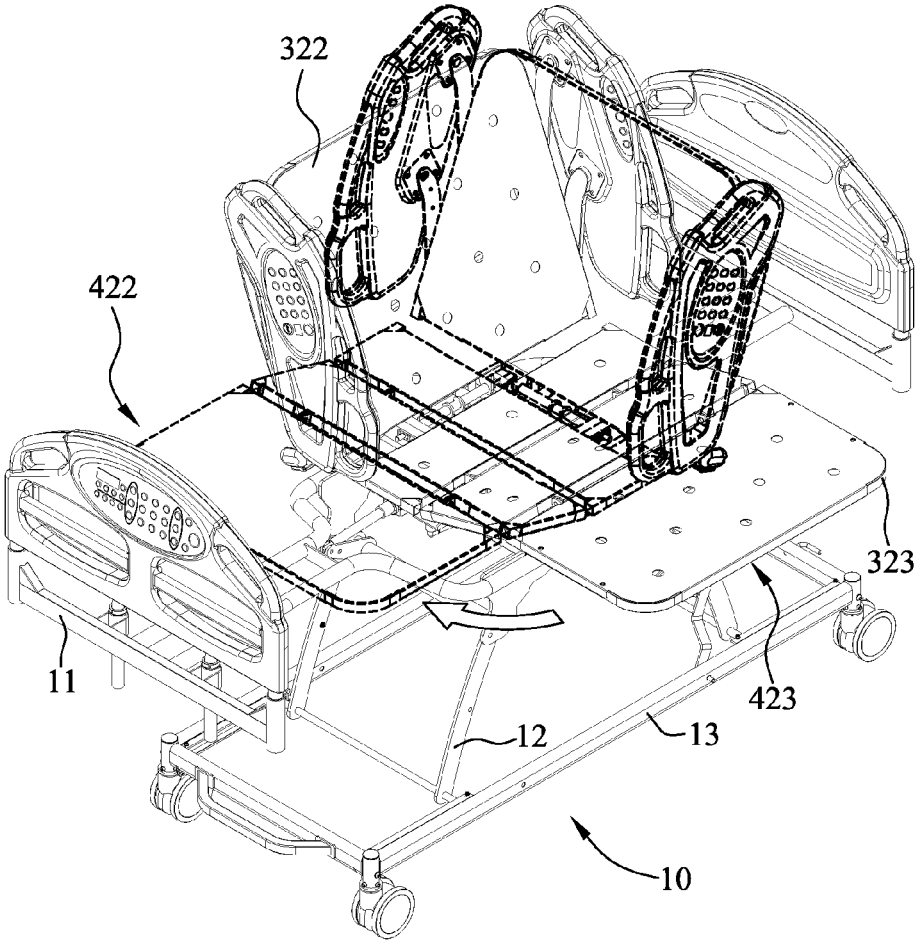

Please refer to FIG. 4 and FIG. 13, when the length of the extendable element 421 of the starting unit 42 is retracted, the bed body structure 30 may be driven by means of the rotating axle 41, and may rotate while encircling a core of the rotating axle 41. The deflected position 423 may move to the placement position 422 in a clockwise direction. In accordance with the preferred exemplary embodiment of the present invention, the bearing 20 located that is located in between the bed frame structure 10 and the bed body structure 30 may reduce the frictional force between the bed frame structure 10 and the bed body structure 30. In addition, an upper and lower end of the bearing 20 may be in direct contract with the fixed support 11 of the bed frame structure 10 and the connecting support 31 of the bed body structure 30, such that the pivotal turning device 40 may enable the bed body structure 30 to collectively provide a back and forth swinging action between the placement position 422 and the deflected position 423 by means of smaller transmission power.

However, the bed body structure 30 rotating and moving to the deflected position 423 in a counterclockwise direction as well as rotating and moving to the placement position 422 in a clockwise direction have been stated for illustrative purposes only, and are not meant to be limiting. That is to say, the assembly connecting relationship between the pivoted arm 411 of the rotating axle 41 and the extendable element 421 of the starting unit 42 may be changed so as to enable the bed body structure 30 to be rotated to the placement position 422 and the deflected position 423 in a single direction.

Please refer to FIG. 2 and FIG. 14, the length of the second extendable rod 331*a* of the second driving source 331 is retracted so as to enable the movable member 332 to move and to drive the assembly connection position between the prop member 333 and the limiting member 334 to provide a downward displacement. As such, the prop member 333 and the limiting member 334 may gradually be presented horizontally. Furthermore, the first flipped plate 322 may be flipped towards the lower surface of the fixed plate 321 by means of a tilt-like state until the surface of the first flipped plate 322 is in parallel with the surface of the fixed plate 321, whereby the patient may easily go to bed for recovery of treatment to be achieved.

In summary, when the length of the extendable element 421 of the driving unit of the present invention is extended or retracted, the plurality of pivoted arms 411 may rotate about the core of the rotating axle by means of extending or retracting the extendable rod, and at the same time, the bed body structure 30 may be driven and rotated. As such, the bed structure located in between a deflected position 423 that projects from a side of the bed frame structure and a placement position 422 that does not project from a side of the bed frame structure rotate back and forth, whereby the patient may carry out the action of getting out of the bed without any increase in the burden to the body.

In addition, a lifting and lowering device 50 may be located in between the frame body 13 of the bed frame structure and the fixed support, so as to be used for changing a spacing distance in between the frame body 13 and the fixed support as well as for extending or retracting the length of the second extendable rod 331*a* and the third extendable rod 341*a* by means of the second driving source 331 and the third driving source 341. As such, the flip angles of the first flipped plate 322 and the second flipped plate 323 of the bed plate 32 may be changed. Therefore, the rotating bed may represent different usage forms in accordance with the needs of patients.

Moreover, an bearing 20 may be installed in between the fixed support of the bed frame structure and the connecting support 31 of the bed body structure 30. An upper and lower end of the bearing 20 may be in contract with the fixed support and the connecting support 31. As such, the bed frame structure may support the weight of the bed body structure 30 and the weight of the patient with a view to increasing the security of using the improved structure of a rotating bed of the present invention. In addition, the bed body structure 30 may be rotated with a smaller rotational torque towards the side of the bed frame structure by means of the bearing 20 so as to achieve the purpose of convenience.

Although the above preferred exemplary embodiments of the present invention have been described with reference to the preferred exemplary embodiments thereof, it may be apparent to those ordinarily skilled in the art that a variety of modifications and changes may be made without departing from the scope of the present invention which is intended to be defined by the appended claims.

What is claimed is:

1. A rotating bed for medical care, comprising:

a bed frame structure, comprising a fixed support;

a bed body structure that is located on top of the fixed support, and comprising a connecting support;

a pivotal turning device, comprising a rotating axle and a starting unit, wherein the rotating axle is fixed on the connecting support, and comprises a plurality of pivoted arms, and the starting unit is in connection with the bed frame structure, and comprises an extendable element that is in connection with one of the plurality of pivoted arms; and a bearing that is located in between the fixed support of the bed frame structure and the connecting support of the bed body structure, wherein the rotating axle passes through the bearing, and an upper and lower end of the bearing are respectively in direct contact with the fixed support and the connecting support, wherein, when the length of the extendable element of the starting unit is extended or retracted, the pivoted arm rotates while encircling an axis of the rotating axle, and driving a rotation of the bed body structure, so as to enable the bed body structure that is located in between a deflected position that projects from a side of the bed frame structure and a placement position that does not project from a side of the bed frame structure to rotate back and forth, and at the same time, the starting unit represents a back and forth swinging action by means of the pivoted arm rotating while encircling the axis of the rotating axle.

2. The rotating bed for medical care in accordance with claim 1, wherein the pivotal turning device further comprises an auxiliary extendable member, and wherein the auxiliary extendable member comprises a supporting end that is in connection with the bed frame structure and an extendable end, the extendable end is installed on another pivoted arm, and the auxiliary extendable member represents a back and forth swinging action at the same time when the pivoted arm rotates while encircling the axis of the rotating axle.

3. The rotating bed for medical care in accordance with claim 1, wherein the bed frame structure further comprises a frame body, and a lifting and lowering device is located in between the frame body and the fixed support, so as to be used for changing a spacing distance in between the fixed support and the frame body.

4. The rotating bed for medical care in accordance with claim 3, wherein the lifting and lowering device comprises two swing frames that are pivoted with the two ends of the fixed support, a plurality of guided tracks that are installed on the frame body and two first driving sources, and wherein a connecting rod is connected on one side of the swing frame, two sliding blocks that slide in the guided tracks are installed on the swing frame so that the connecting rod and sliding blocks are on opposite sides of the swing frame, and the first driving source is in connection with the bed frame structure, and comprises a first extendable rod that is installed on the connecting rod.

5. The rotating bed for medical care in accordance with claim 1, wherein the bed body structure further comprises a bed plate, and the connecting support comprises a base that is in direct contact with the fixed support, the two ends of the base extends upwards so as to form a support member that is installed on the bed plate.

6. The rotating bed for medical care in accordance with claim 5, wherein the bed plate comprises a fixed plate that is fixed at the top ends of the two support member and a first flipped plate that is located on a side of the fixed plate, and a first flipped device is assembled between the first flipped plate and the base, the first flipped device enables the first flipped plate to carry out flipping while the first flipped plate is faced towards the upper surface of the fixed plate.

7. The rotating bed for medical care in accordance with claim 6, wherein the first flipped device comprises:

a second driving source that is located in between the two support members, is installed on the base, and comprises a second extendable rod;

a movable member that is installed on the second extendable rod, and the movable member moves in a linear manner while facing the direction of the two ends of the support member, as a result of the changes in length of the second extendable rod;

at least a prop member, wherein one end of the at least a prop member turns pivotally to the movable member, and another end of the at least a prop member is fixed on the first flipped plate; and at least a limiting member, wherein one end of the at least a limiting member is pivoted in/on the support member, and another end of the at least a limiting member is pivoted with the at least a prop member;

when the second extendable rod extends or retracts its length, so as to enable the movable member to move in a linear manner towards one end of the support member, this drives the flipping of the prop member and the limiting member, and the flipping of the at least a prop member and the at least a limiting member becomes a folded state, so as to enable the first flipped plate to flip while facing the upper surface or lower surface of the fixed plate.

8. The rotating bed for medical care in accordance with claim 7, wherein the support member comprises a sliding track, and the movable member comprises a movable block that is installed on the sliding track.

9. The rotating bed for medical care in accordance with claim 6, wherein the bed plate further comprises a second flipped plate, wherein the second flipped plate is installed on the fixed plate so that the first flipped plate and the second flipped plate are on opposite sides of the fixed plate, and a second flipped device is assembled between the second flipped plate and the base; and the second flipped device enables the second flipped plate to carry out flipping while the second flipped plate is faced towards the lower surface of the fixed plate.

10. The rotating bed for medical care in accordance with claim 9, wherein the second flipped device comprises:

a third driving source that is installed on the base, wherein the third driving source is located in between the two support members, and comprises a third extendable rod; and a positioning support that comprises two fixed members that are fixed on the bed body structure, wherein a rotating rod that rotates while in connection with the fixed member is assembled between the two fixed members; the rotating rod comprises a pivoted section that is pivoted to the third extendable rod, and a contact section that is installed on the second flipped plate;

wherein when the length of the third extendable rod is retracted or extended, the rotating rod carries out rotation by means of the pivoted section, so as to enable the contact section of the rotating rod to drive the flipping of the second flipped plate towards the lower surface or upper surface of the fixed plate.

11. The rotating bed for medical care in accordance with claim 10, wherein a third flipped plate is assembled between the fixed plate and the second flipped plate, and the two ends of the third flipped plate are respectively pivoted with the fixed plate and the second flipped plate, when the upper surface of the second flipped plate and the upper surface of the fixed plate are presented horizontally, and when the length of the third extendable rod is extended continuously, the third flipped plate is flipped so as to form an inclined position, such that the second flipped plate and the third flipped plate are enabled to be located in different planes.

* * * * *